US005364096A

United States Patent [19]

Cebula et al.

[11] Patent Number: 5,364,096

[45] Date of Patent: Nov. 15, 1994

[54] MULTIPLE BALL FEED UNIT FOR PINBALL MACHINE

[75] Inventors: Edwin Cebula, West Chicago; Joseph E. Kamikow, Arlington Heights, both of Ill.

[73] Assignee: Data East Pinball, Inc., Melrose Park, Ill.

[21] Appl. No.: 79,458

[22] Filed: Jun. 18, 1993

[51] Int. Cl.[5] ..... A63F 7/34

[52] U.S. Cl. ..... 273/121 A; 273/121 D

[58] Field of Search ..... 273/118-125, 273/127

[56] References Cited

U.S. PATENT DOCUMENTS

| | | | |
|---|---|---|---|
| 4,548,408 | 10/1985 | Clark | 273/121 A |
| 5,002,279 | 3/1991 | Kamikow et al. | 273/121 A X |
| 5,048,832 | 9/1991 | Kaminkow | 273/119 A X |
| 5,226,653 | 7/1993 | Bil et al. | 273/121 A |

*Primary Examiner*—Vincent Millin
*Assistant Examiner*—Raleigh W. Chiu
*Attorney, Agent, or Firm*—Gerstman, Ellis & McMillin, Ltd.

[57] ABSTRACT

A pinball machine comprises a frame which carries a playfield, a chute and a driver for launching balls onto the playfield through the chute. A spent ball-receiving aperture in the playfield communicates with a sloped trough positioned under the playfield. The trough is of a length to hold a plurality of balls, preferably more than three balls. An upper end of the trough communicates with the aperture, while the lower end of the trough is positioned adjacent to and below the chute and the ball driver for launching. A solenoid or the like is positioned to vertically elevate the ball occupying the trough lower end, typically by striking it to cause the ball to fly to a new position in the chute for launching. Sensors are present to determine the number of balls in the trough. A microprocessor and other electronics are present for actuating the solenoid or the like for vertically elevating the ball to the chute for launching. Balls may be automatically launched, being fed from the trough, in a manner responsive to events taking place on the playfield.

17 Claims, 1 Drawing Sheet

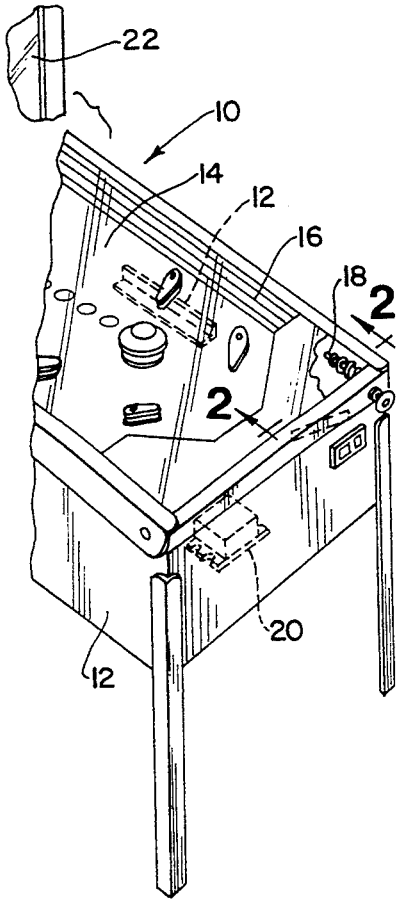
Fig. 1
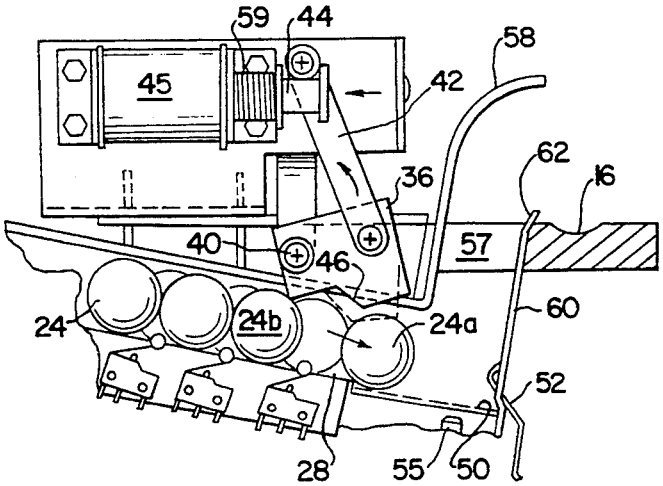
Fig. 3
Fig. 2
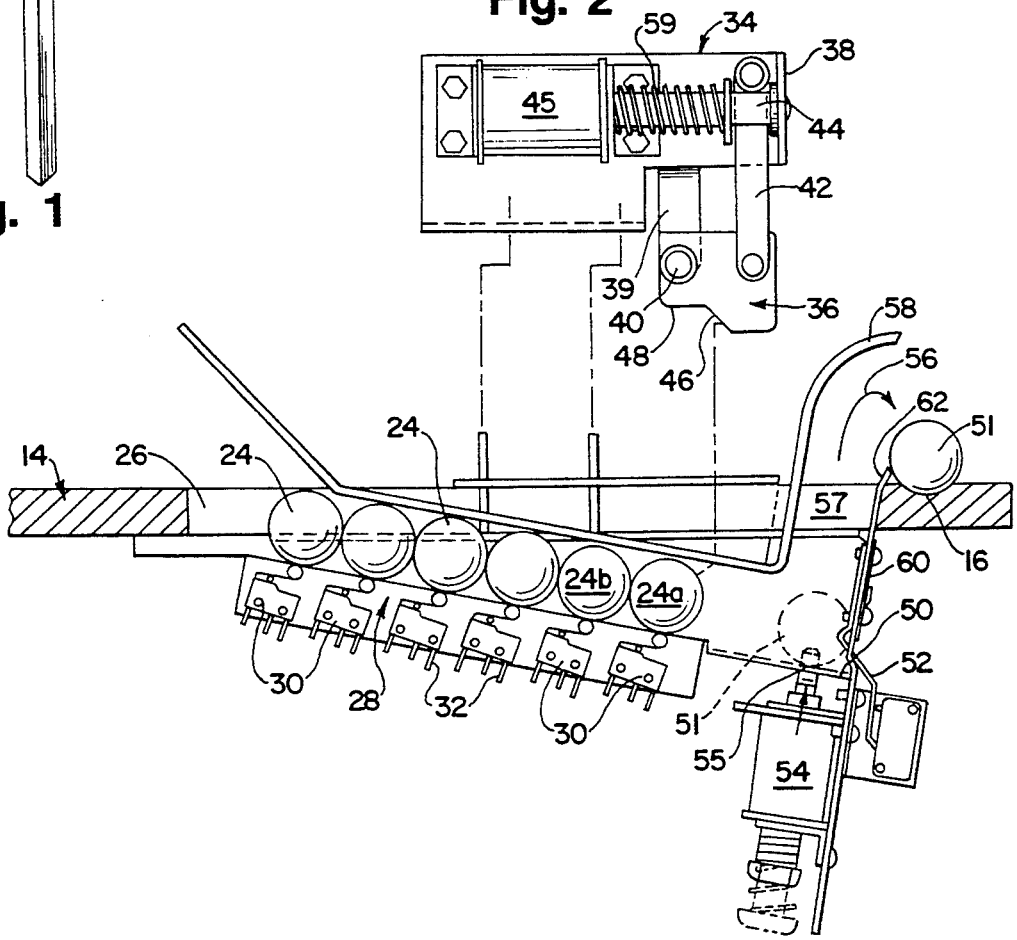

MULTIPLE BALL FEED UNIT FOR PINBALL MACHINE

BACKGROUND OF THE INVENTION

Pinball machines are currently in use which have multiple ball systems. Typically, such machines have the capability of automatically putting three balls into play at the same time, as the result of a score or other event that takes place during the pinball game. The balls are automatically launched, although the player also may have the capability of launching balls manually.

With such a multiple ball system, the pinballs which are waiting to be launched reside on a 3-ball track which is positioned on the playfield near the player's end, with the track being of the shape of an inverted V. Other balls may be held in eject holes on the playfield until they are released by the game program. At one end, the track communicates with the ball driver and the chute which is used for launching the pinballs onto the playfield. At the other end of the track there is a "kicker" for propelling the balls from that end of the track to the other.

By this invention, a pinball machine is provided having a multiple ball feed unit capable of feeding more than three balls into the game, for example six balls, in automatic sequence for increased game excitement.

DESCRIPTION OF THE INVENTION

By this invention a pinball machine is provided which comprises a frame which carries a playfield. Chute and driver means are provided for launching balls onto the playfield in conventional manner. A spent ball-receiving aperture is provided in the playfield, communicating with a sloped trough positioned under the playfield. The trough is of a length to hold a plurality of balls, preferably more than three balls. An upper end of the trough communicates with the aperture, while a lower end of the trough is positioned adjacent to and below the chute and driver means. Means are provided for vertically elevating balls occupying the trough lower end, to place the ball into the chute of the chute and driver means. Sensor means are provided to determine the number of balls in the trough, along with electronic means for actuating the elevating means responsive to events taking place on the playfield, to permit launching of balls.

Also, the driver of the chute and driver means may be automatically controlled by the game program to permit automatic, rapid ball launching. Alternatively, the driver means may be manual, or drivers of both types may be used, as shown in Kaminkow U.S. Pat. No. 5,048,832.

Preferably, the ball elevating means comprises an actuator for striking and propelling upwardly the ball in the trough lower end. A curved guide plate stands above the playfield to guide the upwardly propelled ball to the chute for launching. Typically the ball is propelled upwardly through an aperture in the playfield.

Also, the chute for launching may substantially occupy the plane of the playfield. A plate is upstanding from the playfield, being positioned to prevent balls in the chute from rolling back to the trough. The height of the plate above the playfield is preferably no more than the radii of the balls in the chute.

This plate can perform an added function in that it may extend downwardly through and below the playfield, to carry the means for vertically elevating the ball, which means is typically a solenoid plunger.

DESCRIPTION OF THE DRAWINGS

FIG. 1 is a fragmentary, perspective view of a pinball machine in accordance with this invention;

FIG. 2 is an enlarged, transverse sectional view taken along a portion of the playfield of the machine of FIG. 1 and line 2—2, showing the row of balls in the sloped trough in their retained position, and the ball retainer separated for clarity of disclosure;

FIG. 3 is a fragmentary, sectional view similar to FIG. 2 showing how the front ball can be released by the ball retainer to roll toward the trough lower end while other balls are retained.

DESCRIPTION OF SPECIFIC EMBODIMENTS

Referring to the drawings, FIG. 1 shows a perspective view of a pinball machine 10, which comprises a frame 12 supporting a pinball playfield 14 which is of generally conventional design, except as otherwise described herein. A shooter assembly comprises a chute 16 and a driver 18, which is typically solenoid-operated, although a manual driver may also be used.

Electronics, including microprocessor 20 are carried in the frame 12 of the machine or in the backboard 22, for control of all of the desired functions of the pinball machine.

Referring to FIG. 2, balls 24 finish their course on the playfield 14 by dropping through aperture 26, which leads to a straight, sloped trough 28, as shown.

Straight trough 28 is carried underneath the playfield 14, with a rear portion of trough 28 carrying ball sensor units 30, which may be microswitches as shown, or may be optical sensing units, by way of another example. The electrical leads 32 of microswitches 30 may communicate in appropriate manner with microprocessor 20, to provide the microprocessor with information about the number of balls present in trough 28, which the microprocessor uses in its game control program.

Balls 24 are retained in their positions of trough 28 over sensors 30 by the presence of ball control mechanism 34 for retaining and releasing balls in a manner which may be controlled by microprocessor 20, in response to events taking place on the playfield and throughout the pinball machine. Also, if desired, balls 24 may be released from control mechanism 34 by manual command as well, and conveyed to chute 16.

Cam 36 is carried on bracket 38 through a pivotal depending arm 39 which is connected through pivot 40 to cam 36. A second arm 42 is pivotally connected to cam 36 at one end, and is pivotally connected at its other end to a spring plunger 44 of a solenoid 45 which, when actuated, moves plunger 44 to the left. Upon such motion, as illustrated in FIG. 3, arm 42 also pivots to the left with the motion of plunger 44, which forces the right hand portion of cam 36 to rise as illustrated in FIG. 3 about pivot point 40.

This, in turn, causes angled ball retention face 46 to rotate out of its engagement with front ball **24*a* as shown by the comparison of FIGS. 2 and 3. At the same time, the lower left hand corner 48 of cam 36 is forced to rotate downwardly, which has the effect of blocking the rolling of ball 24*b*, while ball 24*a* is thus released to roll to the lower end 50 of trough 28. In that new position, ball 24*a* actuates a microswitch 52, providing electronic communication of its presence to microprocessor 20**.

Upon receipt of command to load chute 16 with a ball 24, plunger 55 of solenoid 54 may be activated to drive ball 51 upwardly as indicated by arrow 56, with enough kinetic energy to fly upwardly through aperture 57 in the board that defines playfield 14. Curved shroud 58 serves to guide the path of motion of ball 51, and to direct it to its desired position in chute 16, to be launched by the action of driver 18. This substantially vertical ball feeding system eliminates problems of the prior art.

When solenoid 45 is deactivated, the spring 59 surrounding plunger 44 causes the plunger and arm 42 to move again to the position of FIG. 2, which causes pivot cam 36 to rotate clockwise back to its position of FIG. 2. This releases ball 24*b*, allowing it to move to the former position of ball 24*a*, rolling along trough 28, but the rolling motion of ball 24*b* is stopped by the impeding presence of angled face or surface 46 of cam 36, which, once again, is in a position to block a ball in the position of ball 24*a* in FIG. 2.

It can be seen that the pinball machine shown is capable of rapid fire launching of up to 8 pinballs, either on a manual basis, or automatically as governed by microprocessor 20.

By way of further advantage of the pinball machine of this invention over that of the prior art, the structure of this invention eliminates the need for a solenoid or other "kicker" at the end of trough 28, opposed to solenoid 54, as in the prior art. Thus a cost saving can be provided by this invention, when compared with prior art multiple ball launching systems.

The respective ball sensors 30 can be used in conjunction with microprocessor 20 to provide differing play action depending how many balls are present in trough 28. In other words, if only the first three sensors 30 indicate the presence of balls, the number of balls automatically loaded and shot, the timing of such loading and shooting as a function of action on the playfield, and other playfield events may be different from when four or six balls are sensed to be present in trough 28. Thus the game can exhibit great variety of play action. Also, the number of balls played can be sensor-monitored by the program to terminate the game at the proper time.

The ball retainer 34 and pivot cam 36 are a preferred but not necessary part of the invention, in that the balls in trough 28 may simply rest against each other with a first ball above solenoid 54, to function in the manner of this invention. However, pivot cam 36 tends to reduce the problem relating to the failure of a ball to make it from trough end 50 to a position in chute 16 for launching onto the playfield. When this happens, a stack of two balls may be present over solenoid 54, which may interfere with the game. This problem is reduced by the controlled feeding of the respective balls to the trough end 50, as controlled by pivot arm 36.

Plate 60 extends through playfield 14 so that a small obtuse-angled tip 62 of plate 60 projects above the playfield. This serves as a baffle to prevent balls from rolling back out of chute 16, through aperture 57, to trough end 50 again.

At the same time, plate 60 also extends downwardly from playfield 14 to carry sensor 52 and solenoid 54, as shown.

The above has been offered for illustrative purposes only, and is not intended to limit the scope of the invention of this application, which is as defined in the claims below.

That which is claimed is:

1. A pinball machine which comprises a frame which carries a playfield; a chute and driver for launching balls onto the playfield; a spent ball-receiving aperture in the playfield communicating with a sloped trough positioned under the playfield, said trough being of a length to hold a plurality of balls; an upper end of said trough communicating with said aperture, and a trough lower end positioned adjacent to and below said chute and driver; a device for elevating a ball occupying said trough lower end, to place said ball into the chute; sensors to determine the number of balls in said trough; and electronic circuitry for actuating said elevating device for automatically providing balls to the chute and driver; and a member upstanding from the playfield, positioned to prevent balls in the chute from rolling back to said trough.

2. The pinball machine of claim 1 in which the height of the member above the playfield is no more than the radii of the balls in the chute.

3. The pinball machine of claim 1, in which said chute substantially occupies the plane of said playfield.

4. A pinball machine which comprises a frame which carries a playfield; a chute and driver for launching balls onto the playfield; a spent ball-receiving aperture in the playfield communicating with a sloped trough positioned under the playfield, said trough being of a length to hold a plurality of balls; an upper end of said trough communicating with said aperture, and a trough lower end positioned adjacent to and below said chute and driver; a device for elevating a ball occupying said trough lower end, to place said ball into the chute of said chute and driver; sensors to determine the number of balls in said trough; and electronic circuitry for actuating said elevating device and said chute and driver for automatically launching balls responsive to events taking place on said playfield, said elevating device comprising an actuator to strike and propel upwardly said ball in the trough lower end; a curved guide member standing above the playfield to guide the upwardly propelled ball to said chute; and a member, upstanding from the playfield, positioned to prevent balls in the chute from rolling back to said trough.

5. The pinball machine of claim 4 in which the height of the member above the playfield is no more then the radii of the balls in the chute.

6. The pinball machine of claim 4 in which said member extends downwardly through and below the playfield, and carries said device for elevating said balls.

7. The pinball machine of claim 4 in which said trough is straight.

8. The pinball machine of claim 4 in which said ball-receiving aperture is circular.

9. A pinball machine which comprises a frame which carries a playfield; a chute and driver for launching balls onto the playfield; said playfield defining a rolling path for spent balls on the playfield to drop into a sloped trough positioned under the playfield at a point adjacent an upper end of said sloped trough, said trough being of a length to hold a plurality of balls; a trough lower end being positioned adjacent to and below said chute and driver; a device for elevating a ball occupying said trough lower end to place said ball into the chute; sensors to determine the number of balls in said trough; and electronic circuitry for actuating said elevating device for automatically providing balls to the chute and driver; and a member, upstanding from the playfield, positioned to prevent balls in the chute from rolling back to said trough.

10. The pinball machine of claim 9 in which said member extends downwardly through and below the playfield, and intersects said trough to serve as a ball stop at the lower end of said trough.

11. The pinball machine of claim 10 in which said member carries said device for vertically elevating said ball.

12. The pinball machine of claim 10 in which said pinball machine further comprises a guide member standing above said playfield to guide the vertically-elevated ball to said chute.

13. The pinball machine of claim 9 in which said pinball machine further comprises a guide member standing above said playfield to guide the ball to said chute.

14. A pinball machine which comprises a frame which carries a playfield; a chute and driver for launching balls onto the playfield; said playfield defining a rolling path for spent balls on the playfield to drop into a sloped trough positioned under the playfield at a point adjacent an upper end of said sloped trough; said trough being of a length to hold a plurality of balls; a trough lower end being positioned adjacent to and below said chute and driver; a device for elevating a ball occupying said trough lower end to place said ball into the chute; sensors to determine the number of said balls in said trough; and electronic circuitry for actuating said elevating device for automatically providing balls to the chute and driver, said chute substantially occupying the plane of said playfield; and a member upstanding from the playfield, positioned to prevent balls in the chute from rolling back to said trough; said member extending downwardly through and below the playfield, and carrying said device for vertically elevating said ball.

15. The pinball machine of claim 14 in which said elevating device comprises an actuator to strike and propel said ball in the trough lower end upwardly.

16. The pinball machine of claim 15 further comprising a curved guide member standing above said playfield to guide the upwardly-propelled ball to said chute.

17. The pinball machine of claim 14 in which said member extends downwardly through and below the playfield, and intersects said trough to serve as a ball stop at the lower end of said trough.

* * * * *